US011692320B2

(12) United States Patent
Doy et al.

(10) Patent No.: US 11,692,320 B2
(45) Date of Patent: Jul. 4, 2023

(54) MILLING MACHINE CHAMBER BINDING CONTROL SYSTEMS AND METHODS

(71) Applicant: Caterpillar Paving Products Inc., Brooklyn Park, MN (US)

(72) Inventors: Nathaniel S. Doy, Maple Grove, MN (US); Lee M. Hogan, Mackinaw, IL (US); Austin R. Bies, Saint Louis Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 129 days.

(21) Appl. No.: 16/985,039

(22) Filed: Aug. 4, 2020

(65) Prior Publication Data

US 2022/0042255 A1 Feb. 10, 2022

(51) Int. Cl.

| | |
|---|---|
| ***E01C 23/088*** | (2006.01) |
| ***E01C 23/12*** | (2006.01) |
| *E01C 23/07* | (2006.01) |

(52) U.S. Cl.

CPC ..... *E01C 23/088* (2013.01); *E01C 23/127* (2013.01); *E01C 23/07* (2013.01)

(58) Field of Classification Search

CPC ..... E01C 23/088; E01C 23/127; E01C 23/07

See application file for complete search history.

(56) References Cited

U.S. PATENT DOCUMENTS

| | | | | |
|---|---|---|---|---|
| 4,041,623 | A | 8/1977 | Miller et al. | |
| 8,246,270 | B2 | 8/2012 | Berning et al. | |
| 8,764,118 | B1 | 7/2014 | Krishnamoorthy et al. | |
| 8,794,867 | B2 | 8/2014 | Snoeck et al. | |
| 8,899,689 | B2 | 12/2014 | Killion | |
| 9,267,446 | B2 | 2/2016 | Killion et al. | |
| 2013/0341996 | A1* | 12/2013 | Franzmann | E01C 23/088 299/1.5 |
| 2014/0035343 | A1* | 2/2014 | Berning | E01C 23/127 299/1.5 |
| 2014/0049093 | A1* | 2/2014 | Berning | E21C 47/00 299/39.6 |
| 2016/0160455 | A1* | 6/2016 | Vogt | E01C 23/127 299/1.5 |
| 2019/0161924 | A1* | 5/2019 | Gerhardy | E01C 23/088 |

FOREIGN PATENT DOCUMENTS

| | | |
|---|---|---|
| CN | 104032659 B | 8/2016 |

* cited by examiner

*Primary Examiner* — Abby J Flynn
*Assistant Examiner* — Michael A Goodwin
(74) *Attorney, Agent, or Firm* — Bookoff McAndrews, PLLC

(57) ABSTRACT

A milling machine is provided comprising a frame including a plurality of height-adjustable legs; a rotor; a rotor chamber including a movable front wall, a movable rear wall, and a pair of movable side walls; and a controller. The controller is configured to enable a rotor chamber binding control during on a lowering of the rotor towards a ground surface; automatically raising at least one of the front wall or the rear wall during the lowering of the rotor; and disable the rotor chamber binding.

20 Claims, 6 Drawing Sheets

MILLING MACHINE CHAMBER BINDING CONTROL SYSTEMS AND METHODS

TECHNICAL FIELD

The present disclosure relates generally to mobile milling machines that may encounter chamber binding events, and more particularly, to a systems and methods for controlling the binding of a chamber of a mobile milling machine.

BACKGROUND

The present disclosure relates to milling machines that are used in road surface preparation or repairs. Milling machines are typically used to remove a layer or layers of ground surface or old or defective road surface in preparation for road formation or resurfacing. Many milling machines include a rotor having rotor bits for breaking up the ground surface, and include a rotor chamber to help direct the milled material toward a conveyor or back toward the surface. Such rotor chambers may include vertically movable chamber walls that surround the rotor and float along the ground surface during the milling operation. Thus, as the milling machine (and rotor) engages the ground, the movable walls can be urged upward by the ground surface. However, certain slopes of the ground surface or misalignment of the front or rear walls of the rotor chamber can cause a binding event that does not allow the front or rear movable walls to retract as the machine is lowered. Such a binding event may cause the machine to rest on the rotor chamber itself as the legs lower the machine rather than cutting deeper. This can cause one or more legs to raise off the ground and the target cut depth may not be achieved.

U.S. Pat. No. 8,246,270, issued to Berning, et al. ("the '270 patent"), describes a self-propelling road milling machine having a track assembly carrying the machine frame through lifting columns. A milling roller is supported on the machine frame for treatment of ground or roadways. The milling rotor is enclosed in a roll case having movable side plates and a movable rear stripping means. First and second sensor means are included for measuring milling depth by movement of the side plates and stripping means. The '270 patent, however, does not address binding of any of the walls of the roll case.

The systems and method of the present disclosure may solve one or more of the problems set forth above and/or other problems in the art. The scope of the current disclosure, however, is defined by the attached claims, and not by the ability to solve any specific problem.

SUMMARY

According to one aspect of the present disclosure, a milling machine is provided comprising a frame including a plurality of height-adjustable legs; a rotor; a rotor chamber including a movable front wall, a movable rear wall, and a pair of movable side walls; and a controller. The controller is configured to enable a rotor chamber binding control during on a lowering of the rotor towards a ground surface; automatically raising at least one of the front wall or the rear wall during the lowering of the rotor; and disable the rotor chamber binding control.

According to another aspect of the present disclosure, a method of operating a milling machine is provided. The milling machine includes a frame having a plurality of height-adjustable legs; a rotor; and a rotor chamber including a movable front wall, a movable rear wall, and a pair of movable side walls. The method comprises enabling a rotor chamber binding control during a lowering of the rotor towards a ground surface; automatically raising at least one of the front wall or the rear wall during the lowering of the rotor; and automatically disabling the rotor chamber binding control.

According to another aspect of the present disclosure, a computer readable medium storing instructions for operating a milling machine is provided. The milling machine includes a frame including a plurality of height-adjustable legs; a rotor; and a rotor chamber including a movable front wall, a movable rear wall, and a pair of movable side walls. The computer readable medium, when executed by at least one controller, causes the one or more controllers to implement instructions for: automatically enabling a rotor chamber binding control during a lowering of the rotor; automatically raising at least one of the front wall or the rear wall during the lowering of the rotor; and automatically disabling the rotor chamber binding control.

DETAILED DESCRIPTION

Both the foregoing general description and the following detailed description are exemplary and explanatory only and are not restrictive of the features, as claimed. The same reference numbers in different alternatives are used to describe the same components or functions. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or can be milled in the removal or formation of roadways. In this disclosure, relative terms, such as, for example, "about," "substantially," "generally," and "approximately" are used to indicate a possible variation of ±10% in a stated value or characteristic. The current disclosure is described with reference to a milling machine. As used herein, a milling machine includes any machine that includes a ground engaging rotor or cutter to displace ground surfaces. Examples of such milling machines include cold planers and ground reclaimers.

Figure 1:
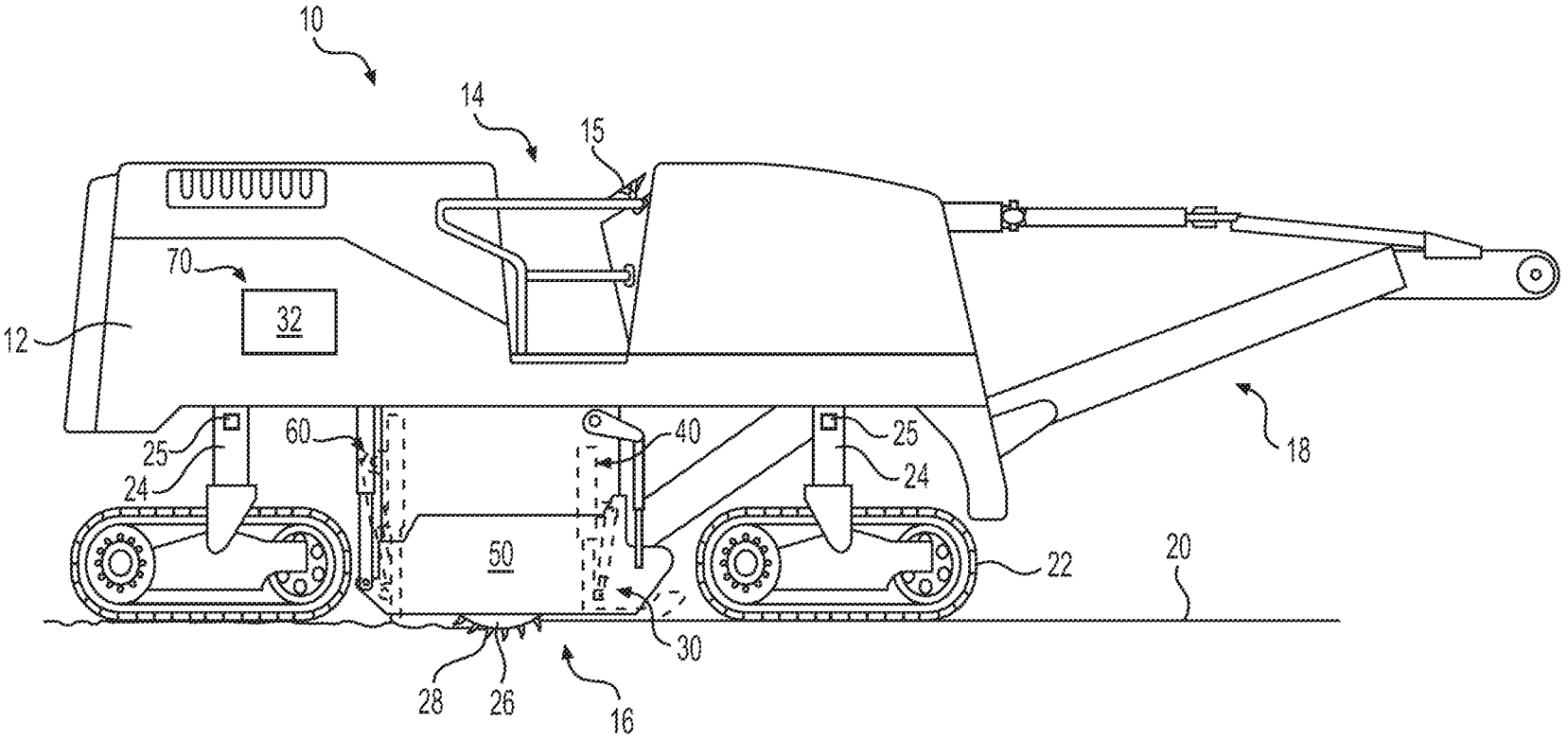
FIG. 1 illustrates an exemplary milling machine having a according to the present disclosure.

FIG. 1 illustrates an exemplary milling machine 10, such as a cold planer machine, according to the present disclosure. Machine 10 includes a frame 12 supporting an operator station 14, and a milling assembly 16 coupled to an under-side of the frame 12. Operator station 14 may include one or more user interface devices, such as a display 15 for monitoring and controlling machine 10. Machine 10 may also include a front-located conveyor assembly 18 configured to advance milled material from milling assembly 16 away from the ground surface 20, for example, to be deposited into a bed of a truck (not shown). Machine 10 includes a plurality of track members or wheels 22 coupled to frame 12 via height-adjustable legs or actuators 24 to provide for a raising and lowering of the machine 10. Machine 10 may further include one or more controllers 32 sending and receiving signals for monitoring and controlling the operation of machine 10.

Figure 2:
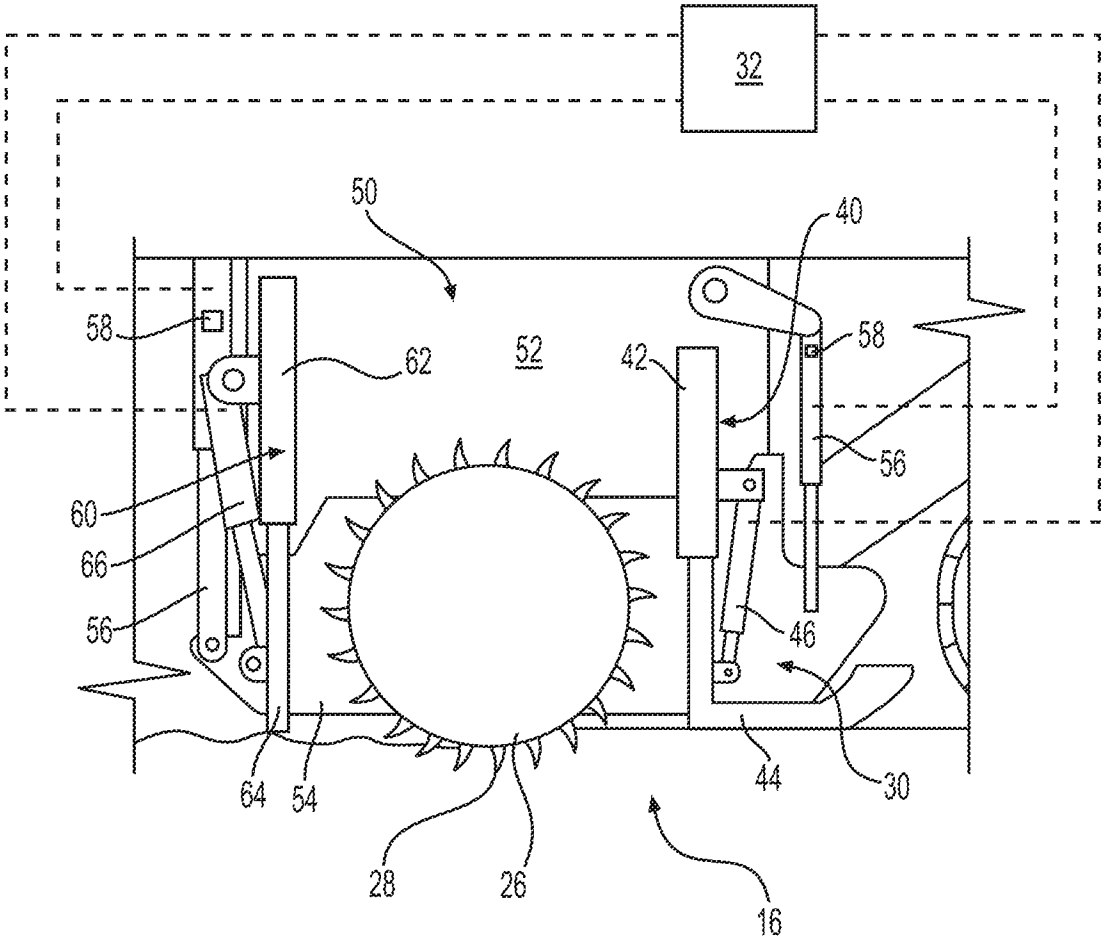
FIG. 2 illustrates the rotor chamber of the milling machine of FIG. 1.

Referring to FIGS. 1 and 2, milling assembly 16 may include a ground-engaging rotor or cutter 26 having rotor bits 28. The rotor 26 may be enclosed within a series of walls forming a rotor chamber 30. The walls of the rotor chamber 30 may include a movable front wall 40, a pair of movable side walls 50 (only one shown in FIG. 1), and a movable rear wall 60 at the rear of the rotor chamber 30. During operation, as rotor 26 rotates in ground surface 20, the walls (40, 50, 60) of rotor chamber 30 ride along ground surface 20 and form a barrier that retains much of the milled material, and urges the milled material toward the conveyor assembly 18.

Referring to FIG. 2, movable front wall 40 may include an upper support wall 42, a movable lower or antislab wall 44, and one or more actuators 46 coupled between the upper support wall 42 and antislab wall 44 for controllably moving the antislab wall 44 vertically. Similarly, movable side walls 50 may include an upper support wall 52, a movable lower wall 54, and one or more actuators 56 coupled between the upper support wall 52 and the lower wall 54 for controllably moving the lower walls 54. Movable rear wall 60 may include an upper support wall 62, a movable lower or moldboard scraper wall 64 and one or more actuators 66 coupled between the upper support wall 62 and moldboard scraper wall 64 for controllably moving the moldboard scraper wall 64 vertically.

Actuators 46, 56, and 66 of rotor chamber 30 may be any type of actuator, for example hydraulic actuators. While only one actuator 46, 56, 66 is shown for each of the movable walls 40, 50, 60, it is understood that more than one actuator may be used for each wall. As generally shown by the dashed lines in FIG. 2, the actuators 46, 56, and 66 may be controlled in any appropriate manner, such as by a controller 32 and appropriate signals and hydraulic circuits (not show). Further, the side wall actuators 56 may include position sensors or detectors 58. The position sensors 58 may be of any conventional design to send signals to controller 32 indicative of position of the respective actuator. From this information, controller can determine the vertical location and/or movement of the side walls 50. The actuators 46, 56, 66 may provide for three different states of the movable walls 40, 50, 60, a floating state where the movable walls are free to move with the contours of ground surface 20, a locked state where the actuators 46, 56, 66 fix the movable walls 40, 50, 60 in a particular vertical position, and a moving state where the actuators 46, 56, 66 urge a wall (40, 50, or 60) either vertically up or down.

Figure 3:
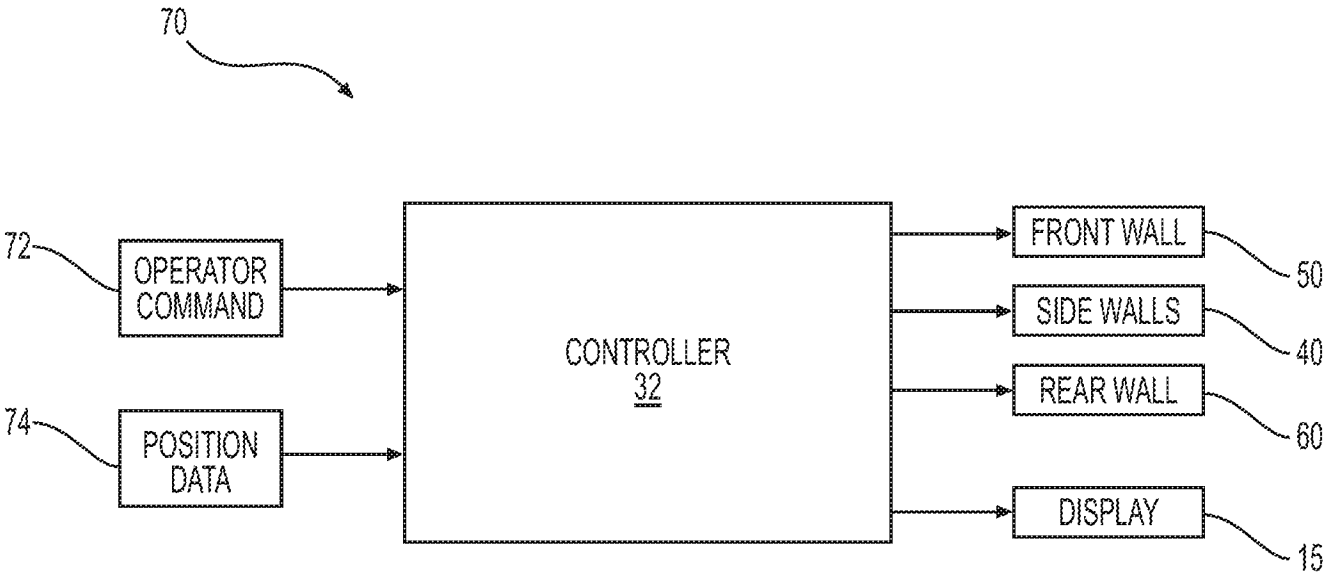
FIG. 3 illustrates an exemplary control system for the milling machine of FIG. 1.

Referring to FIG. 3, a control system 70 of machine may include controller 32 configured to send and receive signals for the monitoring and controlling machine 10. In particular, control system 70 is configured to provide the machine binding detection and resolution systems and methods of the present disclosure. Controller 32 may be in any conventional form and may include, for example, hardware, software, and firmware for executing various instructions or functions, including those described in connection with the method of FIGS. 4A and 4B. For example, controller 32 may include one or more processors, memory, communication systems, clocks, and/or other appropriate hardware. Controller 32 may be, for example, a single or multi-core processor, a digital signal processor, microcontroller, a general purpose central processing unit (CPU), and/or other conventional processor or processing/controlling circuit or controller. The memory may include, for example, read-only memory (ROM), random access memory (RAM), flash or other removable memory, or any other appropriate and conventional memory. Communication systems associated with controller 32 (e.g., between controller 32 and various components of machine 10) may include, for example, any conventional wired and/or wireless communication systems such as Ethernet, Bluetooth, and/or wireless local area network (WLAN) type systems.

As shown in FIG. 3, controller 32 may receive operator command signals 72 from an operator of machine 10 via, for example, a user interface such as display 15 located in the operator station 14. Controller 32 may also receive position data 74 of various components of machine 10. For example, controller 32 may receive position data of side walls 50 or track leg actuators 24 via the position sensors 58 discussed above, and thereby determine the vertical positions of such components. Controller 32 may also send signals to various components of machine 10. For example, controller 32 may send signals to control various aspects machine 10, including front wall 40, side walls 50, and rear wall 60. For example, controller 32 may send signals to control the actuators (24, 46, 56, 66) to control the state of the actuators—floating, fixed, or moving. Controller may also send signals to control display 15, for example, to notify operator of various aspects of machine 10.

INDUSTRIAL APPLICABILITY

The disclosed machine binding detection and resolution systems and methods may be applicable to any machine having a rotor and rotor chamber 30, and may assist in resolving a binding event that can cause inefficient or detrimental operation of machine 10.

Figure 4A:
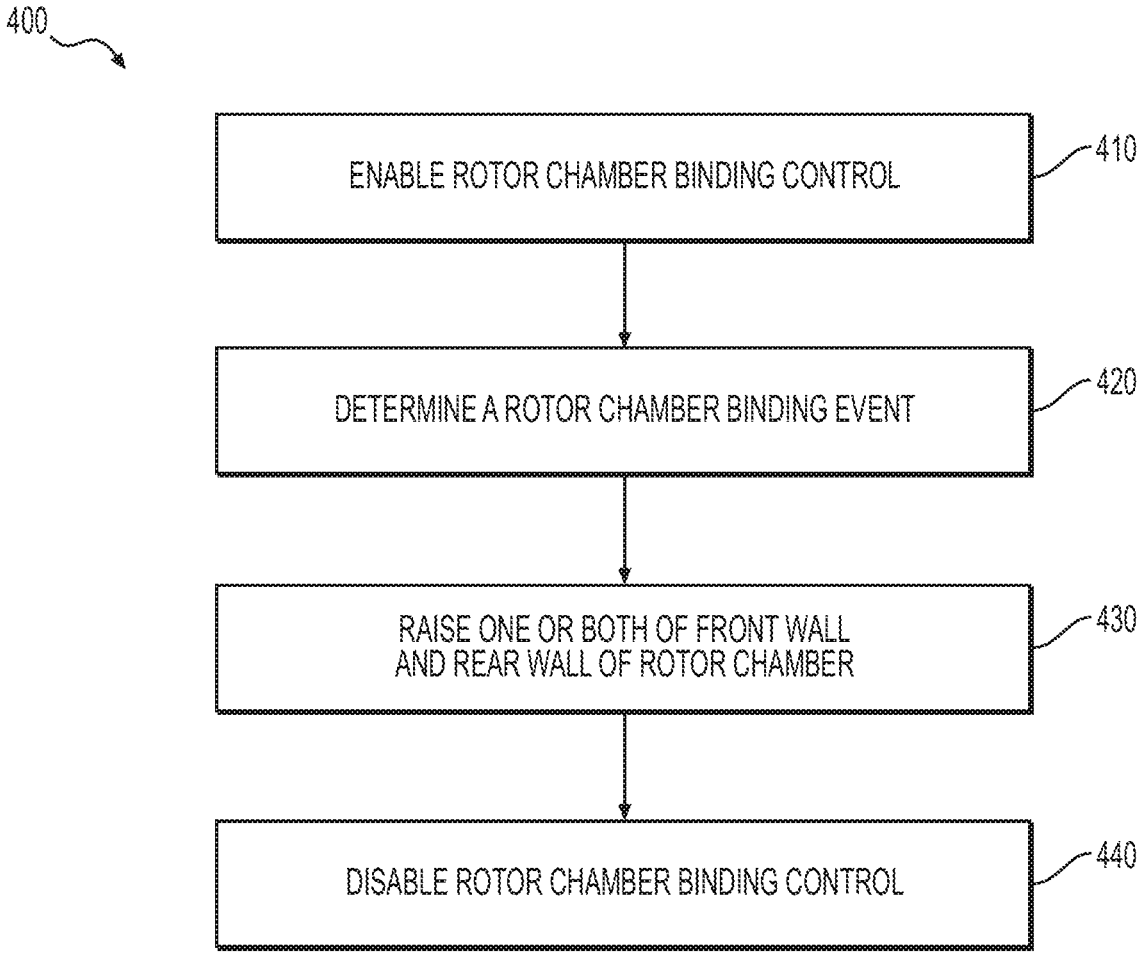
FIG. 4A shows an exemplary process for rotor chamber binding control.
Figure 4B:
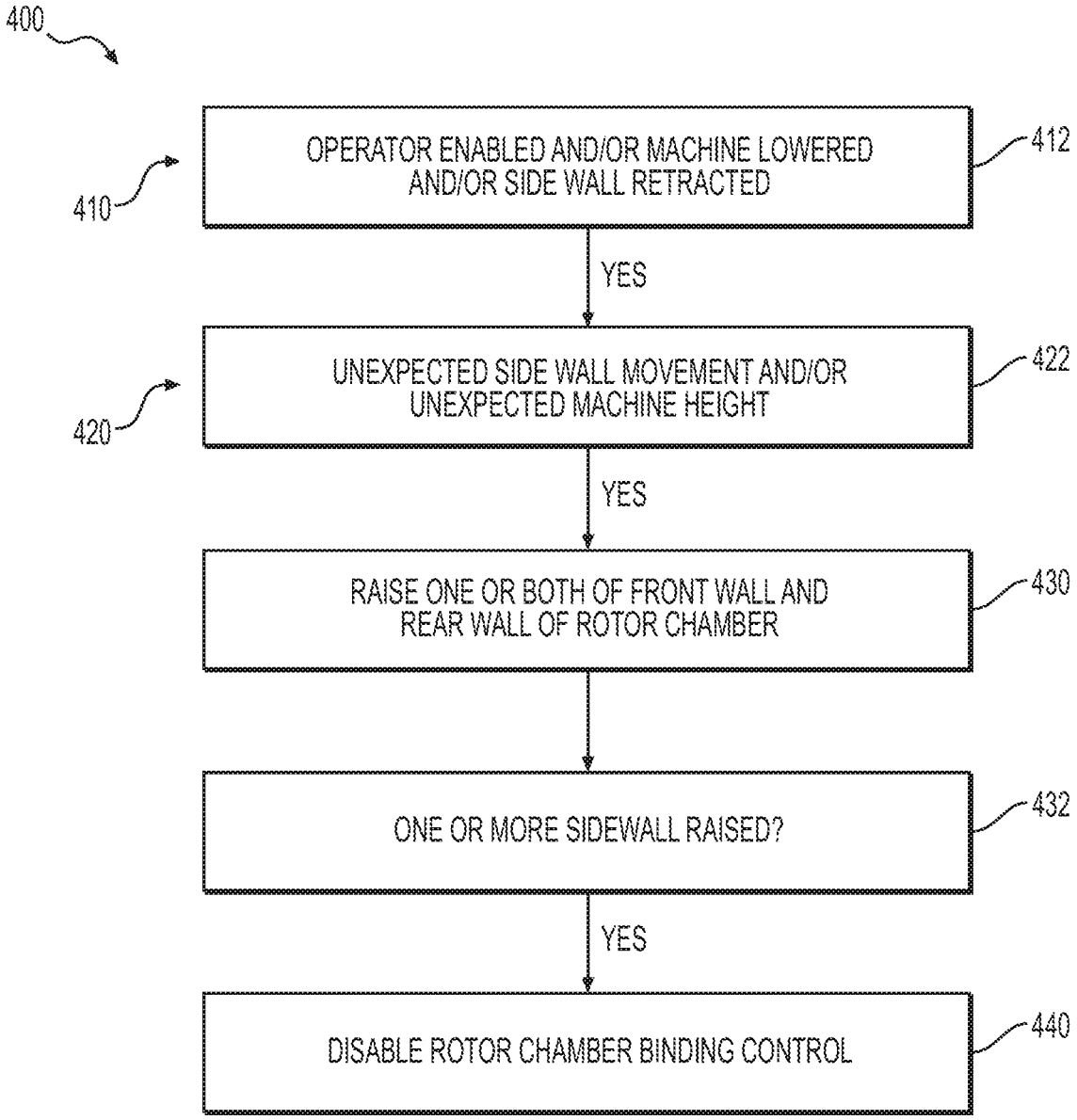
FIG. 4B shows further details of the exemplary process of FIG. 4A.

FIGS. 4A and 4B provide an exemplary method 400 of binding detection and resolution. Normal milling operation of the rotor chamber 30 provides a vertical "floating" of the front, side, and rear movable walls 40, 50, 60. The floating is achieved by control of the actuators (46, 56, 66) so that the actuators are able to freely move (extend or retract) with the contours of ground surface 20. However, slope variations or misalignment of the front or rear walls 40, 60 may cause one or both of the front and rear walls 50 to bind and thus trigger a binding event. Such a binding event may prohibit the machine 10 from lowering, and in some cases, may cause one or more track members 22 to raise above the ground surface 20 when lowering of the machine is attempted (via leg actuators 24). This can result in the machine 10 being vertically supported, at least in part, by the front or rear walls 40, 60. The method of FIGS. 4A and 4B addresses and resolves this binding event.

As shown in FIG. 4A, the method 400 of the present disclosure includes step 410 of enabling rotor chamber binding control; step 420 of determining a rotor chamber binding event; step 430 of raising at least one of the front wall 40 or rear wall 60; and step 440 of disabling the rotor chamber binding control.

Referring to FIG. 4B, the enabling of the rotor chamber binding control (step 410) can be based on an operator command, such as an operator selecting an icon on the display 15 to enable rotor binding control. Alternatively or in addition, the rotor chamber binding control may be initiated or enabled automatically when certain conditions of the machine 10 are met. In the case of such automatic initiation or enabling of the rotor chamber binding control, the operator may allow or disable the rotor chamber binding control as a user preference in the settings of the machine 10. As indicated in step 412 of FIG. 4B, in one example, the initiation of the rotor binding control may require one or both of (1) the leg actuators 24 indicating a machine lowered condition, and (2) the side wall actuators 56 indicating that one or both of the side walls 50 have been retracted (i.e., walls 50 being less than fully extended). The satisfaction of these conditions can be determined by position sensors 25, 58 associated with the leg actuators 24 and/or side wall actuators 56. Such conditions may help ensure that rotor binding control takes place during a lowering of the machine 10 as part of the entering of the cut in a milling operation or during propelling when performing the main portion of the cut, rather than when the machine is in a raised condition and not milling, such as when the machine 10 is in a travel mode.

The determination of a rotor chamber binding event (step 420) may include determining a movement characteristic of at least one of the side walls 50. See step 422 of FIG. 4B. In particular, the determination may be based on whether one or more of the side walls has moved as expected. For example, during a lowering of machine 10 by retraction of the leg actuators 24, there will be an expected retraction of one or more side walls 50. If, for a predetermined time period, this expected movement does not take place (i.e., no movement at all), or the movement of a side wall 50 is at a rate that is not commensurate with the lowering of the machine, then a binding event is identified. This corresponds to a binding of one or both of the front wall 40 or rear wall 60 with the ground, and thereby not obtaining the expected movement (or any movement) of the side walls 50 based on contact of the side walls 50 with the ground surface 20. The movement of the side walls 50 may be determined by, for example, position sensors 58 associated with side wall actuators 56, and interplay with controller 32. Identification or determination of the rotor chamber binding event (step 420) may be displayed on display 15 to provide notice to the machine operator.

Alternatively, determination of the a rotor chamber binding event (step 420) may be include using a machine height sensor, such as a sonic-type sensor, (not shown) that can communicate with controller 32 to compare the machine height with the movement of the leg actuators 24 (by position sensors 25). If the sensed height of the machine 10 is not commensurate with the position of the leg actuator 24, for example the machine 10 is sensed as being higher than the position derived from a position sensor of leg actuator 24, then a binding event is identified. Again, this corresponds to a binding of one or both of the front wall 40 or rear wall 60 with the ground and thereby not allowing the machine to lower even when the leg actuators 24 are retracted.

In response to the determination of a rotor chamber binding event (step 420) controller 32 may send signals to discontinue a floating state of one or more of the front and rear walls 40, 60, and raise one or both of the front wall 40 and the rear wall 60 (step 430). By actively moving the front or rear walls 40, 60, the respective actuators 46, 66 actively move one or more of the front or rear walls 40, 60 to lower the machine 10 and unbind the rotor chamber 30. The movement of the front and/or rear walls 40, 60 may continue until a raising of one or both of the side walls 50 is determined (by controller 32 and position sensors 58). At that point, the controller 32 disables the rotor chamber binding control (step 440).

Figure 5:
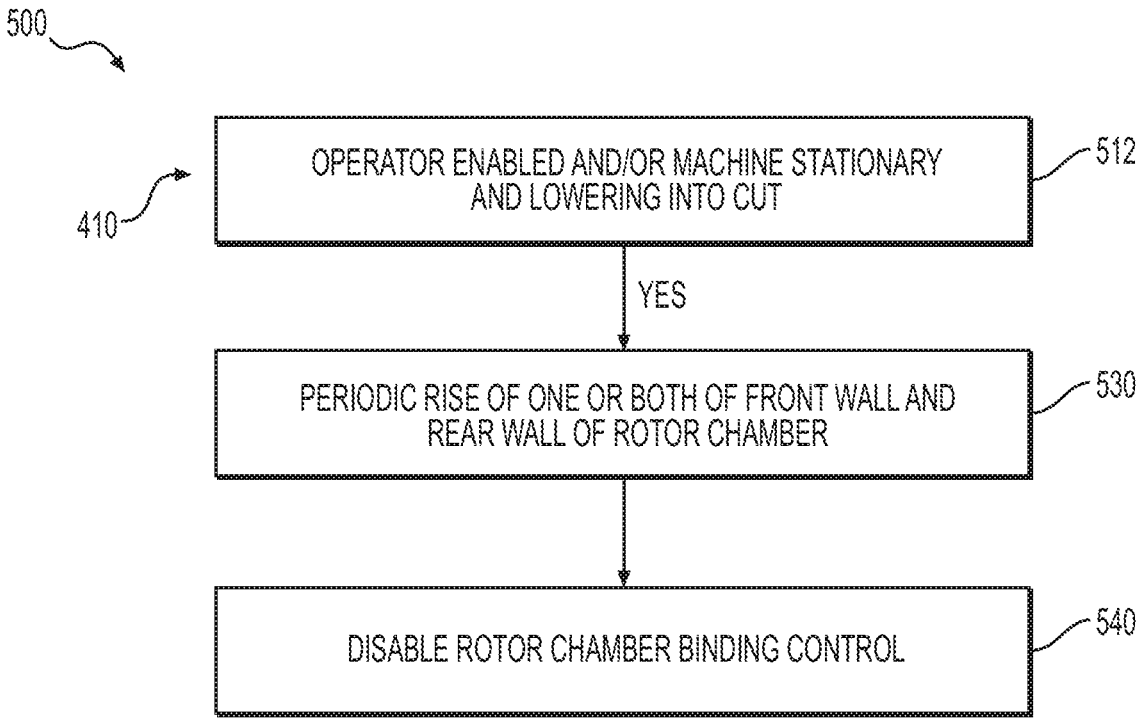
FIG. 5 shows an exemplary process for rotor chamber binding control according to another aspect of the present disclosure.

FIG. 5 provides an alternative method 500 of the present disclosure, and includes step 410 of enabling or initiating rotor chamber binding control; step 530 of periodic rise of one or both of front wall and rear wall of rotor chamber; and step 540 of disabling the rotor chamber binding control.

The enabling or initiating of the rotor chamber binding control (step 410) takes place during a lower of the rotor 26 into a cut, and can be based on an operator command, such as an operator selecting an icon on the display 15 to enable rotor chamber binding control. Alternatively or in addition, the rotor chamber binding control may be initiated or enabled automatically when certain conditions of the machine 10 are met. In the case of such automatic initiation or enabling of the rotor chamber binding control, the operator may allow or disable the rotor chamber binding control as a user preference in the settings of the machine 10. As indicated in step 512 of FIG. 5, in one example, the initiation of the rotor binding control may require one, a plurality, or more of the following machine conditions: (1) the machine 10 is stationary (not being propelled); (2) at least one of the leg actuators 24 indicate a machine lowering condition; (3) the rotor rotating; (4) the front and/or rear wall 40, 60 in the float condition; and/or (5) side wall actuators 56 indicating that one or both of the side walls 50 have been retracted (i.e., walls 50 being less than fully extended). The satisfaction of these conditions can be determined by appropriate systems of machine 10. For example, machine speed, track position, or any other appropriate sensors or indicators can be used to determine if the machine is stationary—not being propelled. Further position sensors 25, 58 associated with the leg actuators 24 may be used to determine a machine lowering condition. A rotor speed sensor or any other appropriate system may determine if rotor 26 is rotating. Further, a hydraulic valve sensor or other appropriate indicator may be used to determine whether the front and/or rear walls are in the float condition. Finally, sensors associated with side wall actuators 56 can be used to determine whether one or both of the side walls 50 have been retracted. As noted above, any one or more the above five conditions can be used to automatically determine whether to initiate the rotor chamber binding control. According to one aspect, all of the five conditions are required to initiate the rotor chamber binding control. Such conditions may help ensure that rotor binding control takes place during a lowering of the rotor 26 into the cut in a milling operation, and while the machine is not propelling.

In response to the initiation or enabling of the rotor chamber binding control (step 410/512), controller 32 may send signals to automatically and periodically raise one or both of the front and rear walls 40, 60. In one aspect, only the rear wall 60 (e.g. moldboard scraper 64) will be controlled for periodic raising. For example, as the machine is being lowered into the cut, the rear wall actuators 66 will periodically raise the rear wall 60 for a first time period, and then place the raised wall in a float condition for a second time period, and repeat this raising and floating process until the machine rotor 26 has been lowered to a desired position. In one example, the first and second time periods may each be less than one second, such as the first time period may be approximately 500 ms, and the floating pause (second time period) may be approximately 400 ms. However, these particular time periods are exemplary only and may be other time periods. Further, the rise and float time periods may be varied during the lowering of the rotor 26. The time periods may be selected to allow the rear wall 60 to float back down after the first time period, and approximately maintain the rear wall 60 on the ground surface (i.e., prevent any significant gap between the rear wall 60 and the ground surface while the machine 10 is plunging into the cut).

When the controller 32 determines that the rotor 26 has been lowered to a desired position or depth (e.g. via position data 74), controller may disable the rotor chamber binding control (Step 540), thereby discontinuing the periodic raising of the rear wall 60 (and/or front wall 40). As used herein, a desired rotor position or depth corresponds to an actual depth of rotor 26, a height of machine 10, or any other measure that corresponds to a depth of rotor 26.

The above-described machine chamber control systems and methods may provide for a simple and automatic avoidance and/or resolution of a chamber binding event of a milling machine. Accordingly, the system and methods requires little or no user interaction to avoid or overcome a chamber binding event. Also, the system and method may provide for a more accurate cut by avoiding or automatically unbinding the system each time a binding event is sensed—even for less significant biding events that do not require substantial response, but nonetheless negatively affect the depth of cut. Further, by controlling the chamber binding event based on only certain sensors and/or movement of only certain actuators (e.g. side wall actuators 56 with position sensor 58, or leg actuators 24 via position sensor 25) less sensors are required on machine 10.

It will be apparent to those skilled in the art that various modifications and variations can be made to the disclosed machine without departing from the scope of the disclosure. Other embodiments of the machine will be apparent to those skilled in the art from consideration of the specification and practice of the system and methods described herein. For example, the above described process steps need not be performed in the order described, but rather certain steps can be performed in a different order and/or can be performed simultaneously with other steps. It is intended that the specification and examples be considered as exemplary only, with a true scope of the disclosure being indicated by the following claims and their equivalents.

What is claimed is:

1. A milling machine, comprising:
- a frame including a plurality of height-adjustable legs;
- a rotor;
- a rotor chamber including a movable front wall, a movable rear wall, and a pair of movable side walls; and
- a controller configured to:
  - enable a rotor chamber binding control during a lowering of the rotor towards a ground surface;
  - automatically determine a rotor chamber binding event;
  - in response to the determination of the rotor chamber binding event, automatically raise at least one of the front wall or the rear wall during the lowering of the rotor;
  - discontinue the raising of at least one of the front and the rear wall when movement of at least one of the side walls is detected; and
  - disable the rotor chamber binding control.

2. The milling machine of claim 1, wherein automatically raising at least one of the front wall or the rear wall includes raising one of the front wall or the rear wall for a first time period, and thereafter allowing the raised wall to float for a second time period.

3. The milling machine of claim 2, further including repeating the raising and floating until the rotor is at a desired depth.

4. The milling machine of claim 2, wherein the first time period and the second time period are configured to maintain the raised wall on the ground surface.

5. The milling machine of claim 2, wherein the first time period and the second time period are each less than one second.

6. The milling machine of claim 2, wherein the raised wall is only the rear wall.

7. The milling machine of claim 2, wherein the rotor chamber binding control is automatically enabled upon satisfaction of at least one of the following conditions:
- (1) the milling machine is not being propelled;
- (2) at least one of the height-adjustable legs are being lowered;
- (3) the rotor is rotating;
- (4) one of the front or rear walls are in a float condition; or
- (5) side walls are less than fully extended.

8. The milling machine of claim 7, wherein the automatic enabling of the rotor chamber binding control includes satisfaction of at least two of the conditions.

9. The milling machine of claim 2, wherein the step of disabling the rotor chamber binding control occurs when the rotor obtains a desired depth.

10. The milling machine of claim 1, wherein the determination of the rotor chamber binding event includes sensing a stopping of movement of at least one of the side walls during a lowering of the rotor.

11. A method of operating a milling machine having a frame including a plurality of height-adjustable legs; a rotor; and a rotor chamber including a movable front wall, a movable rear wall, and a pair of movable side walls; the method comprising:
- enabling a rotor chamber binding control during a lowering of the rotor towards a ground surface, wherein the enabling of the rotor chamber binding control is conditioned on the machine not being propelled;
- automatically raising at least one of the front wall or the rear wall during the lowering of the rotor; and
- automatically disabling the rotor chamber binding control.

12. The method of claim 11, wherein automatically raising at least one of the front wall or the rear wall includes raising one of the front wall or the rear wall for a first time period, and thereafter allowing the raised wall to float for a second time period.

13. The method of claim 12, further including repeating the raising and floating during the lowering of the rotor.

14. The method of claim 12, wherein the first time period and the second time period are configured to maintain the raised wall on the ground surface.

15. The method of claim 12, wherein the first time period and the second time period are each less than one second.

16. The method of claim 12, wherein the raised wall is only the rear wall.

17. The method of claim 11, further including
- automatically determining a rotor chamber binding event;
- performing the raising of at least one of the front wall and the rear wall in response to the determination of the rotor chamber binding event; and
- discontinuing the raising of at least one of the front and the rear wall when movement of at least one of the side walls is detected.

18. A non-transitory computer readable medium storing instructions for operating a milling machine, the milling machine having a frame including a plurality of height-adjustable legs; a rotor; and a rotor chamber including a movable front wall, a movable rear wall, and a pair of movable side walls, wherein when the instructions are executed by at least one controller including a memory storing the instructions for operating the milling machine, the instructions cause the at least one controller to:

automatically enable a rotor chamber binding control during a lowering of the rotor, wherein the lowering of the rotor is provided by lowering the frame via the height-adjustable legs;

automatically determine a rotor chamber binding event;

in response to the determination of the rotor chamber binding event, automatically raise at least one of the front wall or the rear wall during the lowering of the rotor;

discontinue the raising of the at least one of the front wall or the rear wall when movement of at least one of the side walls is detected; and automatically disable the rotor chamber binding control.

19. The non-transitory computer readable medium of claim 18, wherein the automatically enabling of the rotor chamber binding control is conditioned on the milling machine not being propelled.

20. The non-transitory computer readable medium of claim 18, wherein the instructions cause the at least one controller to enable the rotor chamber binding control on the machine only when the machine is not being propelled.

* * * * *